US007370583B2

(12) United States Patent
Hallin et al.

(10) Patent No.: US 7,370,583 B2
(45) Date of Patent: May 13, 2008

(54) DETONATOR SYSTEM AND METHOD IN CONNECTION WITH THE SAME

(75) Inventors: Sune Hallin, deceased, late of Nora (SE); by Anne-Marie Bokvist, legal representative, Nora (SE); Elof Jönsson, Nora (SE); Jan Westberg, Nora (SE)

(73) Assignee: Dyno Nobel Sweden AB, Nora (SE)

( * ) Notice: Subject to any disclaimer, the term of this patent is extended or adjusted under 35 U.S.C. 154(b) by 134 days.

(21) Appl. No.: 10/505,586

(22) PCT Filed: Mar. 6, 2003

(86) PCT No.: PCT/SE03/00375

§ 371 (c)(1),
(2), (4) Date: Oct. 8, 2004

(87) PCT Pub. No.: WO03/076868

PCT Pub. Date: Sep. 18, 2003

(65) Prior Publication Data

US 2005/0243499 A1 Nov. 3, 2005

(30) Foreign Application Priority Data

Mar. 11, 2002 (SE) ..... 0200703

(51) Int. Cl.
*F42D 1/055* (2006.01)

(52) U.S. Cl. ..... 102/200; 102/206; 102/215; 102/214

(58) Field of Classification Search ..... 102/200, 102/217, 214, 213, 206; 380/255, 28
See application file for complete search history.

(56) References Cited

U.S. PATENT DOCUMENTS

| | | | | | |
|---|---|---|---|---|---|
| 4,576,093 | A * | 3/1986 | Snyder | 102/200 |
| 4,869,171 | A * | 9/1989 | Abouav | 102/215 |
| 4,884,506 | A * | 12/1989 | Guerreri | 102/200 |
| 5,014,622 | A * | 5/1991 | Jullian | 102/312 |
| 5,159,149 | A | 10/1992 | Marsden | |
| 5,214,236 | A * | 5/1993 | Murphy et al. | 102/217 |
| 5,295,438 | A * | 3/1994 | Hill et al. | 102/217 |
| 5,894,103 | A | 4/1999 | Shann | |
| 6,546,873 | B1 * | 4/2003 | Andrejkovics et al. | 102/200 |
| 6,851,369 | B2 * | 2/2005 | Hummel et al. | 102/200 |
| 6,981,343 | B2 * | 5/2005 | Petersen | 318/254 |
| 2002/0085025 | A1 * | 7/2002 | Busis et al. | 345/738 |
| 2003/0101889 | A1 * | 6/2003 | Hallin et al. | 102/206 |
| 2006/0037508 | A1 * | 2/2006 | Rudakevych et al. | 102/206 |
| 2006/0060102 | A1 * | 3/2006 | Boucher et al. | 102/217 |

* cited by examiner

*Primary Examiner*—Michael J. Carone
*Assistant Examiner*—Benjamin P Lee
(74) *Attorney, Agent, or Firm*—Buchanan Ingersoll & Rooney PC

(57) ABSTRACT

A method for wirelessly transmitting data to a control unit, such as a blasting machine, selected from a plurality of control units from an operating device selected from a plurality of operating devices, and a system intended for the method. The control unit is connected to a plurality of detonators, which are controlled by the control unit via an electrical wire or a fuse. The operating device is associated with the appropriate control unit in a step in which address data and/or encryption data is exchanged between the units. Only one operating device can be associated with a predetermined control unit at any given moment. The data transmitted in accordance with the method preferably comprises at least a fire command, which instructs the control unit to fire the detonators.

26 Claims, 4 Drawing Sheets

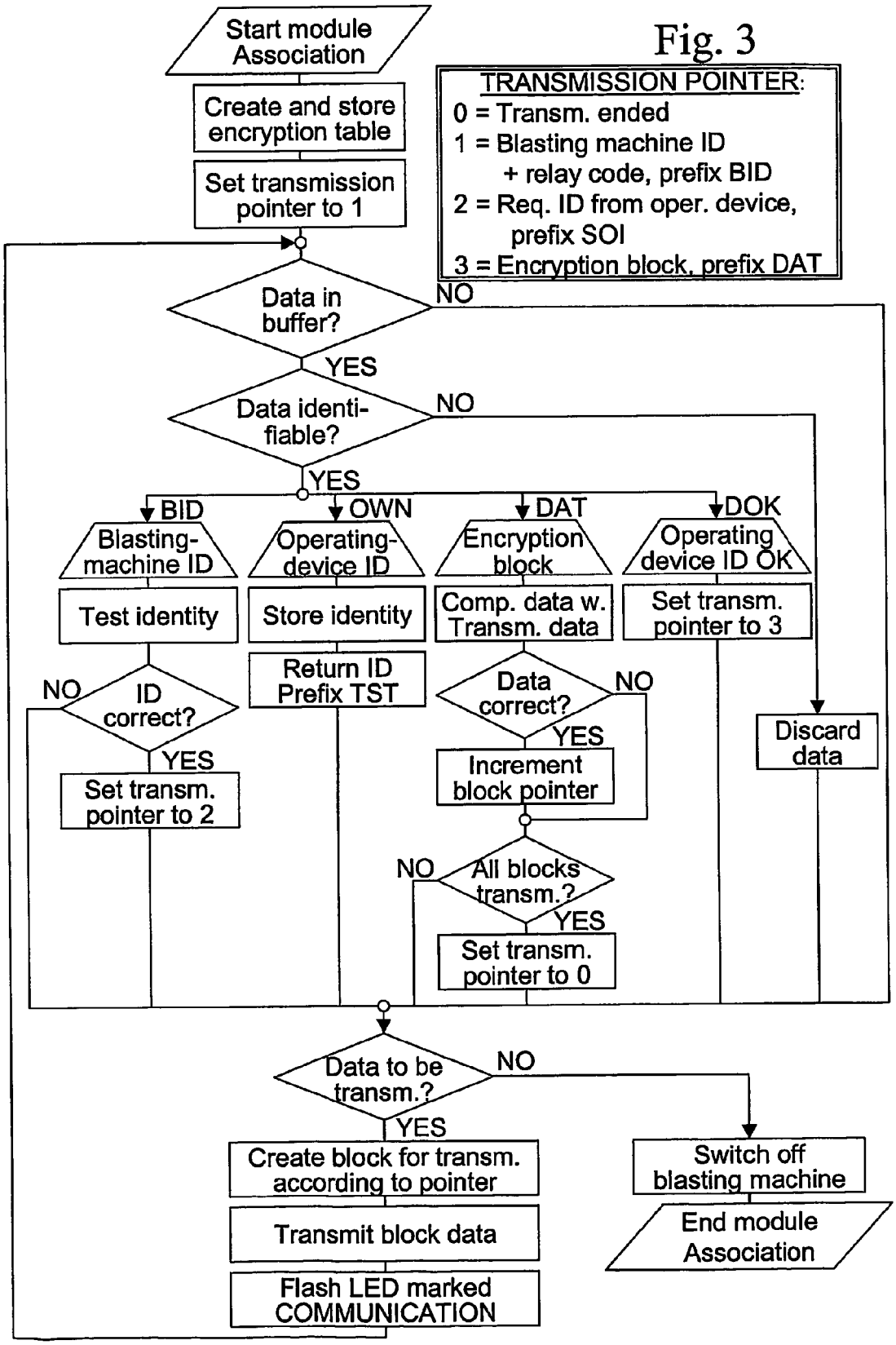
Fig. 3
TRANSMISSION POINTER:
0 = Transm. ended
1 = Blasting machine ID + relay code, prefix BID
2 = Req. ID from oper. device, prefix SOI
3 = Encryption block, prefix DAT
Start module Association
Create and store encryption table
Set transmission pointer to 1
Data in buffer?
NO
YES
Data identi-fiable?
NO
YES
BID
OWN
DAT
DOK
Blasting-machine ID
Operating-device ID
Encryption block
Operating device ID OK
Test identity
Store identity
Comp. data w. Transm. data
Set transm. pointer to 3
ID correct?
NO
YES
Return ID Prefix TST
Data correct?
NO
YES
Discard data
Set transm. pointer to 2
Increment block pointer
All blocks transm.?
NO
YES
Set transm. pointer to 0
Data to be transm.?
NO
YES
Create block for transm. according to pointer
Transmit block data
Flash LED marked COMMUNICATION
Switch off blasting machine
End module Association

DETONATOR SYSTEM AND METHOD IN CONNECTION WITH THE SAME

FIELD OF THE INVENTION

The present invention generally relates to a detonator system for use in blasting operations. More specifically, the present invention relates to a method and a system for wirelessly controlling a detonator system by means of a, preferably portable, operating device. The invention further relates to a control unit and an operating device for implementing the method.

BACKGROUND ART

A detonator is usually used to cause detonation of a large explosive charge, even though detonators themselves, in some cases, can be used as charges. In blasting operations, bores are drilled in which explosives are applied to create a charge. A detonator is arranged in or adjacent to the explosive, which is set off by the intermediary of the detonator.

In large blasting operations, it is often desirable to create a carefully calculated delay of the detonation of the detonators for the purpose of obtaining a desired blasting sequence. The delay is achieved in various ways depending on the type of detonator being used. A detonator may, for instance, be pyrotechnic or electronic. In pyrotechnic detonators, the desired detonation delay is achieved by means of delay charges, which have a preset burning time. In electronic detonators, the desired delay is usually achieved by means of electronic circuits, which count down a programmed delay time and then feed a current to an electric fuse head, which causes the detonator to detonate.

In many cases, it is desirable to be able to walk around the blast site for inspection and monitoring purposes before firing. Furthermore, it may be desirable to be able to initiate firing from any optional site remote from the blast site.

One problem associated with detonator systems according to prior art is that the operator has to initiate firing from a site adjacent to the blast site to be able to physically press the arming and firing buttons of a blasting machine. To set off the detonators, the blasting machine is connected thereto by means of, for example, a fuse or electrical wires. Wireless firing would allow a more flexible system.

Wireless firing of detonators is disclosed, for instance, in U.S. Pat. No. 5,159,149. The purpose of the detonator system described therein is to get round the use of any physical connection between the detonators in a round. According to the description, this purpose is achieved by providing each detonator of the round with a receiver for receiving a fire command signal from a transmitter. When preparing a blast, a transportable charging and programming unit is carried round the blast site, said unit being connected to the respective detonators for charging electric fuse means and for programming the desired delay times in the detonators.

However, the detonator system of the above patent specification has a number of serious limitations and drawbacks. Although the physical interconnection of detonators by means of a fuse or electrical wires has been eliminated, a charging unit that has to be carried round the blast site is required. It is evident that this will complicate the work to be carried out. A further drawback of such a method is that the state of the detonators cannot be checked when the programming unit is disconnected. Consequently, it is not possible to ensure, at a later stage, that the detonators are charged and that they will in fact detonate when receiving a fire command.

Moreover, a system according to the above patent specification is associated with considerable risks. In reality, the person preparing the charges at the blast site will be surrounded by armed detonators, which will detonate upon receipt of a fire command. Any radio frequency interference in the receiver of a detonator, or any inadvertent transmission of a fire command from the transmitter, would therefore have devastating consequences. It is even conceivable that another radio signal source not associated with the detonator system transmits, intentionally or by mistake, a radio signal that is interpreted as a firing signal by the receiver.

Furthermore, each individual detonator has to be provided with a receiver. Considering the fact that a round may comprise a considerable number of detonators, this may imply a significant increase in system costs.

Another general problem associated with wireless firing of detonators is that it is necessary to somehow ensure that only the intended round can be fired. For example, a plurality of rounds may be arranged within a limited area (within one radio coverage area), but it may be desirable to fire only one of these rounds. The obvious problem then is how to make sure that only the intended round is fired.

Accordingly, there is a demand for improved detonator systems that eliminate the risks and problems mentioned above.

SUMMARY OF THE INVENTION

An object of the invention is to solve the above problems associated with prior art by providing secure, wireless control of a control unit, whose function is to fire a number of detonators.

The above object is achieved by a method and a detonator system as defined by the appended claims. Further advantages of the invention will be apparent from the following description.

According to the invention, a detonator system thus comprises a control unit, such as a blasting machine, to which a round of detonators is connected. The round comprises at least one and preferably a plurality of detonators. The connection between the round and the control unit may be realised, for example, by means of one or more fuses or electrical wires. From the operating device, which is preferably portable, commands can be transmitted wirelessly to the control unit. For example, a fire command may be transmitted from the operating device to the control unit, in which case the control unit responds to the fire command by firing the detonators. The detonator system is intended to be controlled by an operator.

According to one aspect, the present invention provides a detonator system in which a control unit can be wirelessly controlled in a secure manner from a portable operating device. The system safety is obtained by transmitting commands (control data) from the operating device to the control unit in accordance with an established communication protocol. Secure transmission of control data from the operating device to the control unit is obtained, for instance, by encryption or by the operating device and the control device having unique sender and receiver addresses that are verified for every transmission.

According to another aspect, the present invention provides a detonator system comprising an operating device selected from a plurality of operating devices, and a control unit selected from a plurality of control units. The selected operating device is then logically linked to, or associated with, the selected control unit. Once the selected operating device has been associated with the selected control unit, the operating device can securely and wirelessly transmit commands to the control unit. Transmission of commands from the operating device to the control unit takes place in such manner that only the intended, selected control unit responds to said commands. This ensures that a predetermined portable operating device can only send commands to the selected control unit with which the operating device is associated. Furthermore, the transmission of commands is done in such a way that only the intended, selected operating device is operable to send said commands to the control unit. This ensures that a predetermined control unit can be wirelessly operated only from a predetermined operating device, viz. the device with which the control unit has been previously associated. However, it is conceivable for the control unit to be operated also by means of buttons provided on the control unit itself, regardless of whether it has been associated with an operating device or not (i.e. local, non-wireless control).

According to a further aspect, the invention provides a detonator system in which the operating device and the control unit are exchangeable for equivalent units between consecutive firings. This is achieved by the control unit being designed in such manner that it can be associated with, or logically linked to, different operating devices, however only one at a time. Correspondingly, the operating device can be associated with different control units, but only one at a time.

A detonator system as described above has several advantages. It allows, among other things, secure wireless control of the control unit. Since only one operating device can be associated with a control unit at any one time, the control unit can be wirelessly operated or controlled only from this particular operating devices. Thus, the control unit cannot be operated or controlled from any other operating device, either intentionally or by mistake. If no operating device has been associated with a predetermined control unit, then this control unit cannot be wirelessly operated by any operating device. This ensures that no one else but the operator in possession of the operating device associated with the control unit can wirelessly cause firing of the detonators comprised in the system.

Another advantage of the system described above is that the operator before each firing can select one operating device and one control unit from a plurality of equivalent devices and units. This means that the operator does not have to handle a separate operating device for each control unit. Instead, the operator has the option to associate any arbitrarily selected control unit and operating device with each other to form a pair before each firing. Naturally, this involves logistic advantages and, in addition, allows a defective operating device or control unit to be put out of operation without affecting any other unit.

A further advantage of a wireless detonator system according to the invention is that the operating device and the blasting machine are reusable. This is achieved by designing them in such manner, and positioning them at such a distance from the detonators, that they are not damaged when the round is fired.

According to another aspect, the present invention provides a method for wirelessly transmitting data in a detonator system from a predetermined operating device to a predetermined control unit, which is connected to a plurality of detonators and controls said detonators. The method comprises the steps of associating the operating device with the control unit, a dedicated communication protocol for wireless communication being established, and transmitting data from the operating device to the control unit in accordance with said communication protocol.

According to a further aspect, the present invention provides a method for secure wireless firing of a number of detonators connected to a predetermined control unit. The wireless firing is initiated from a predetermined, portable operating device, which transmits encrypted data including a fire command to the control unit. The encryption data used to encrypt the commands are known only to the predetermined control unit and the predetermined operating device and is established before firing. This ensures that there is only one portable operating device that, at a given moment, can wirelessly transmit a fire command to the control unit.

According to the invention, the encryption data may be replaced, however, both in the operating device and in the control unit. Nevertheless, when replacing the encryption data any previous encryption data is deleted. A predetermined control unit is responsive only to commands that have been encrypted by means of the latest encryption data. Consequently, the control unit and a second operating device may receive a new set of encryption data, the previous encryption data in the control unit being deleted only the operating device that has received the latest set of encryption data can be used to transmit encrypted data to the control unit. This allows any arbitrarily selected operating device to be used, provided that it has received the current encryption data.

The encrypted signalling according to the present invention thus also minimizes the risk of a lost or stolen operating device being used for the wrong purposes or in an attempt to cause damage.

Alternatively, identities (identity numbers) are exchanged when associating the operating device and the control unit with each other, the identities being used when transmitting data between them. The operating device is designed to only transmit data that is addressed to the control unit with which the operating device was last associated. Correspondingly, the control unit is designed to only transmit data that is addressed to the operating device with which the control unit was last associated. By means of a communication protocol, which requires a correctly addressed transmission of data as well as a correctly addressed response thereto, an unambiguous communication path between the operating device and the control unit is ensured.

According to one preferred embodiment, the present invention provides a detonator system in which a portable operating device is associated with a control unit, for later use in connection with encrypted control and/or monitoring thereof. In this case, encryption data is exchanged during association of the operating device with the control unit, which data is used at a later stage for encrypted transmission of commands from the operating device to the control unit.

According to another preferred embodiment, the present invention provides a detonator system in which a portable operating device can be associated with a control unit, for later use in connection with control and/or monitoring thereof. According to this embodiment, unique identity numbers are exchanged in connection with the association of the operating device with the control unit, said identity numbers being used at a later stage for addressed transmission of data between the operating device and the control unit.

In yet another embodiment, the operating device and the control unit are further adapted to transmit data from the control unit to the operating device. This data may be hidden (e.g. encrypted), as is the case with the commands transmitted from the operating device to the control unit. It may also be public, which means that it can be easily intercepted by devices other than the operating device. This embodiment allows status data regarding the control unit to be transmitted from the control unit to the operating device. The status data may, for instance, contain information about whether or not the control unit is ready to be fired.

Furthermore, it is conceivable for the system to comprise a monitoring unit. The monitoring unit may be designed to interpret all or part of the data and the commands transmitted between the operating device and the control unit. However, it cannot itself transmit equivalent commands or data. This allows transmitted operating commands and/or transmitted status data, if any, to be registered and stored in the monitoring unit. The data may be used at a later stage, for example, as statistical data or to investigate the course of events in the case of an accident. This is possible due to the fact that the transmitted commands contain public data that can be interpreted by devices other than the operating device and the control unit, for example the monitoring unit.

It is also conceivable for the control unit to be operable not only from the operating device but also by means of buttons provided on the control unit.

Preferably, the control unit is responsible also for additional detonator control and verification, such as testing and status checks, and for programming delay times, if applicable. The system may be implemented in a way that allows the delay times to be transmitted to the control unit from the operating device.

According to a particularly preferred embodiment of the invention, a command is transmitted from the portable operating device to a blasting machine, said machine serving as example of a control unit as defined in the present patent application, by (a) the portable operating device transmitting a signal containing an identifier indicating the control unit, (b) the indicated control unit transmitting a signal containing an identifier indicating the operating device concerned, and a pointer indicating an entry in a previously agreed encryption table (which has been communicated during a previous association step), (c) the portable operating device encrypting, by means of the indicated encryption table entry, a command to the control unit and transmitting the encrypted command in a signal containing the identifier indicating the control unit, and (d) the control unit decrypting the command by means of the indicated encryption table entry.

Thus, it is the control unit that specifies which encryption entry is to be used for the next transmission. The control unit randomly selects an encryption entry in the encryption table before each transmission, and each encryption entry is used only once. This ensures a completely secure encryption, since the encryption table was transmitted during a previous step in such manner that it could be interpreted only by the associated operating device. Accordingly, there is only one portable operating device that has access to the correct (the last and, thus, appropriate) encryption table.

According to the invention, a portable operating device is linked to a control unit by the operating device and the control unit exchanging address data and agreeing on an established communication protocol. Moreover, a specific data set is preferably defined, transmission of the data contained in this data set to the control unit being possible only from the predetermined operating device and, from this operating device, only to the predetermined control unit. Thus, a predetermined operating device is associated with a predetermined control unit. Once the units have been associated with each other through exchange of address data and a communication protocol, a secure wireless communication path is deemed to have been established between the units. Consequently, the invention provides a method for securely and wirelessly transmitting data from the operating device to the control unit.

The address data is used for directional transmission of messages between the control unit and the operating device. When the operating device and the control unit, respectively, receive a message with a correct receiver address, each unit checks that the message was intended for it. Upon receipt, a correctly addressed message is subjected to a check to verify that the previously agreed communication protocol is being used. If the received message is not in conformity with the communication protocol, the message is rejected. It is preferred for said communication protocol to use encryption to ensure sufficient unambiguity when verifying the communication protocol. It is also conceivable for a sender address to be transmitted simultaneously, which provides an additional way of ensuring that the current message originates from the right sender.

According to a preferred embodiment of the invention, address data and communication protocol as well as any encryption data are transmitted to the operating device and the control unit, respectively, when the operating device is positioned adjacent the control unit for charging batteries in the operating device. It is thereby possible to ensure that the address data and the communication protocol (as well as the encryption data, if any) are known only to one particular control unit and one particular operating device.

A major advantage of the present invention is that any arbitrarily selected operating device can be used together with any arbitrarily selected control unit, provided that these units have been associated with each other during a preceding presentation procedure as described above. Thus, it is possible on the one hand to make sure that only one operating device at a time is able to use the secure, wireless communication path connecting it to the control unit. On the other hand, any operating device can be associated with the control unit. As soon as an operating device is associated with a control unit, the previous association, if any, is rejected. Accordingly, the association is valid only for the units that were last linked to (associated with) each other.

Thus, a detonator system according to the invention comprises a control unit, such as a blasting machine, and a portable operating device. The control unit is adapted to control a plurality of detonators connected thereto. The detonators may be connected to the control unit by means of electrical wires (such as a bus) or a low-energy fuse wire or tube (such as NONEL™). The operating device is adapted to wirelessly transmit, at the request of an operator carrying the operating device, data containing, for example, an arm command or a fire command to the control unit.

It should be noted that nothing prevents other pieces of equipment from intercepting at least parts of the communication between the control unit and the operating device. This type of interception may be useful, for example, when assessing the function of the system or for statistical purposes.

To conclude, the present invention provides a detonator system comprising an operating device and a control unit, the system presenting, inter alia, the following features:

The operating device and the control unit are capable of communicating via radio signals in a secure manner. The control unit cannot be operated and monitored via radio signals from unauthorised radio transmitters, whether it is a non-specified operating device or control unit or any other radio transmitter.

The operating device and the control unit are designed in such manner that they are each exchangeable for equivalent units. During one firing, a control unit can be controlled from a first operating device, and during another firing, from a second operating device. It goes without saying that subsequent firings can be operated and monitored from one single operating device, but be carried out by different control units.

The operating device and the control unit can be reused after firing a round.

BRIEF DESCRIPTION OF THE DRAWINGS

A preferred embodiment of the present invention will be described below with reference to the accompanying drawings, in which

FIG. 3 is a block diagram describing the process in a control unit when associating the operating device with the control unit.

DESCRIPTION OF PREFERRED EMBODIMENTS

Figure 1:
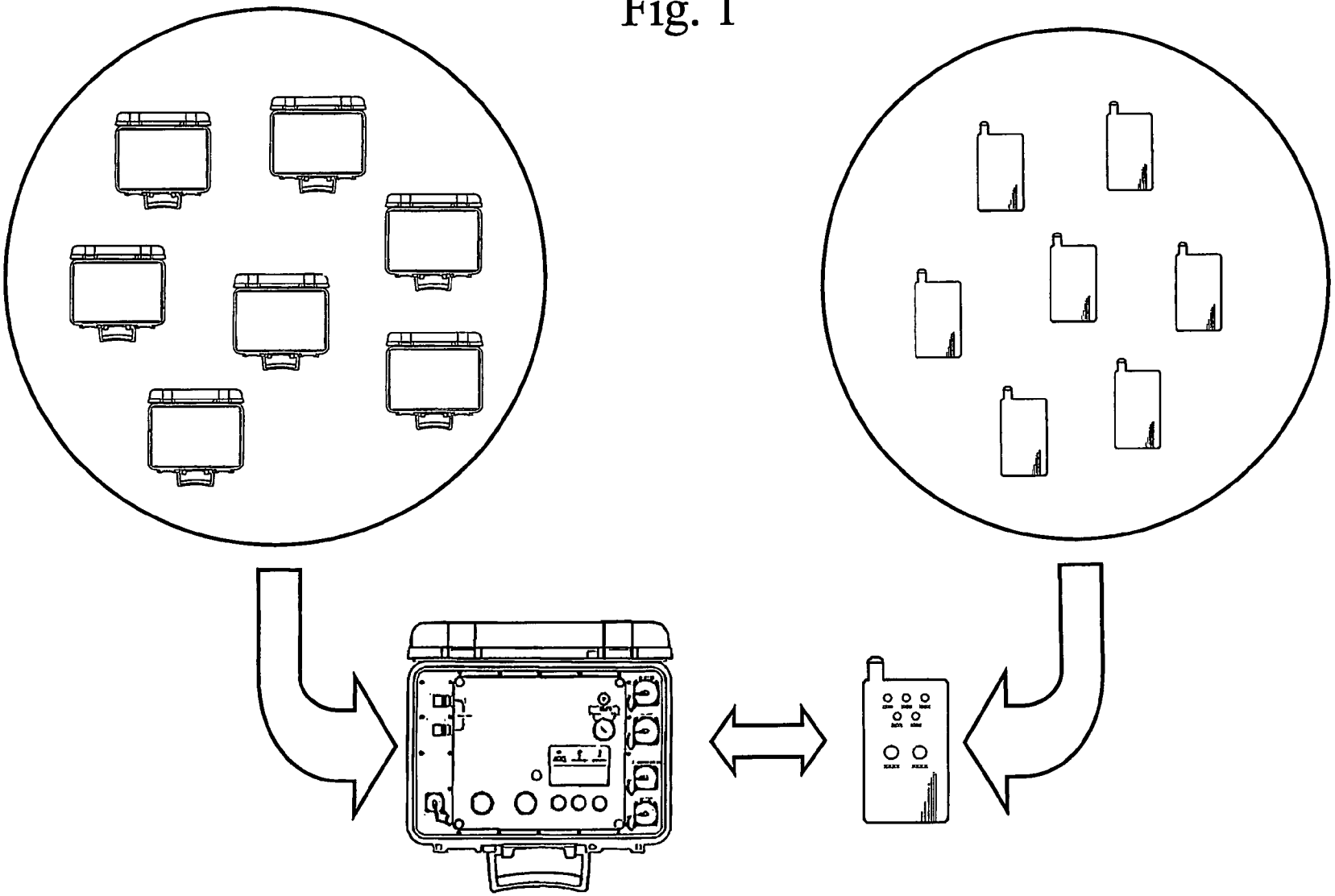
FIG. 1 illustrates the main components of a detonator system according to the invention.

FIG. 1 illustrates the main components of a detonator system according to the invention. The system comprises a portable operating device and a control unit, such as a blasting machine. The control unit is connected to a number of detonators, which together constitute a round. The operating device is used to transmit commands or operating data to the control unit, which in turn is adapted to control the detonators in the round and cause detonation thereof.

A summary review of the system will be presented below with reference to FIG. 1.

The control unit, which usually consists of a blasting machine, and the operating device are both equipped with means for radio communication, which enables them to communicate by sending and receiving radio signals. In addition, the blasting machine and the operating device are equipped with batteries, which supply the current to each device.

The blasting machine is adapted to cause firing of the round. To this end, it is connected to the round. Depending on the design of the detonators constituting the round, the connection may be carried out by means of, for instance, NONEL™-tubing or electrical wires.

The operating device is intended to be used by an operator for controlling the blasting machine by sending control data via radio thereto, and for monitoring the blasting machine by receiving status data via radio therefrom. Furthermore, the operating device and the blasting machine are assigned unique identities, which they are adapted to transmit together with control data or operating commands, so that the receiver and the sender are able to identify each other in an unambiguous manner during communication.

The blasting machine is provided with a holder in which the operating device can be placed when it is not used to control the blasting machine. When the operating device is arranged in the holder, two steps are carried out. One is charging the batteries of the operating device, the other is introducing the operating device and the control unit to each other. In connection with the introduction, the operating device and the blasting machine are associated with each other to allow a secure and unambiguous transmission of data from the operating device to the control unit.

During association of the operating device and the control unit with each other, a common, dedicated communication protocol for wireless communication is established, which enables them to communicate wirelessly with each other. In connection with the introduction, any previous association ceases to be valid. Thus, each operating device can be associated with no more than one blasting machine at any given moment. Correspondingly, each blasting machine can be associated with no more than one operating device at any given moment. The introduction is preferably carried out automatically when the operating device is placed in the holder of the blasting machine.

Figure 2:
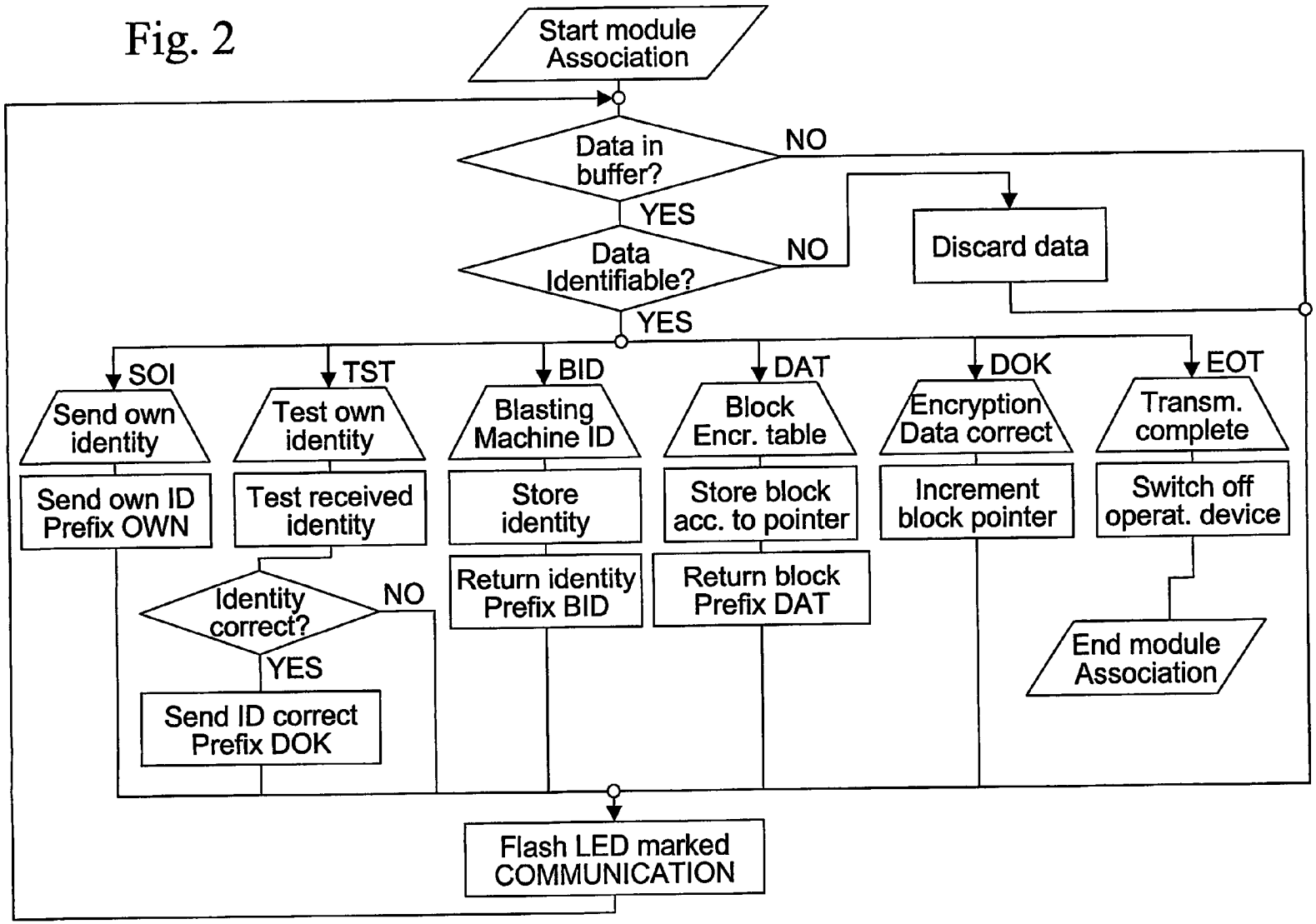
FIG. 2 is a block diagram describing the process in an operating device when associating the operating device with the control unit.

Referring to FIGS. 2 and 3, a preferred method for associating the operating device and the blasting machine (control unit) will be described in more detail below. FIG. 2 is a block diagram illustrating the process taking place in the operating device, and FIG. 3 is a block diagram illustrating the process taking place in the blasting machine. Naturally, the processes in respectively the operating device and the blasting machine are carried out in parallel during the association step.

During association, the blasting machine stores the identity of the operating device in a memory and the operating device stores the identity of the blasting machine in a memory. In order to further ensure that only the desired operating device can be used to control the blasting machine, the communication protocol preferably also requires encryption of selected parts of the radio communication by means of a non-reusable one-loop cipher. During association, an encryption table is therefore randomly generated by the blasting machine, said encryption table being then transmitted to the operating device to be used at a later stage in connection with encrypted transmission of data. It is particularly preferred for definite instructions from the operating device, such as arm commands and fire commands, to be transmitted in encrypted form to the blasting machine.

All communication, or at least transmission of a fire command, preferably takes place by repeating each data string three times, a decision based on a majority of bits determining if the correct string has been received. Thus, each data string is received three times, and two of these strings must be interpreted in the same way to be accepted. In the case of three consecutive non-responses or erroneous responses from the operating device, the blasting machine will return to its normal state and await a new arm signal.

During association, a prefix is preferably assigned to each message, said prefix being used by the receiving unit to distinguish different types of messages. In addition, according to the preferred embodiment the light-emitting diode (LED) marked COMMUNICATION on the transmitting unit will flash during each transmission of data.

The step of associating the operating device and the blasting machine with each other is commenced when the operating device is placed in a special holder provided on the blasting machine. As shown in FIG. 2, the association (mating) begins with the blasting machine creating and storing an encryption table comprising a number of encryption blocks. Preferably, a new encryption table is generated randomly for each new association procedure.

The blasting machine is adapted to hold a transmission pointer indicating one of four different values 0-3, the value 0 meaning that the association is terminated, 1 meaning that the blasting machine should send its own identity together with a relay code, 2 meaning that the blasting machine should request transmission of the identity of the operating device, and 3 meaning that the blasting machine should send an encryption block to the operating device.

When the encryption table has been created and stored in the blasting machine, the transmission pointer in the blasting machine is set to 1. The blasting machine then checks if there is any data in the receive buffer, which at this moment is not the case since the operating device has not yet sent any data. The blasting machine then checks the transmission pointer, which consequently has the value 1. In accordance with the transmission pointer, the blasting machine thus transmits its own identity, a relay code and the prefix BID, and causes its LED marked COMMUNICATION to flash. The identity and relay code of the blasting machine are received and identified in the receive buffer of the operating device. The operating device identifies the prefix BID and stores the identity of the blasting machine in a memory. The operating device then returns the identity of the blasting machine to the blasting machine, including the prefix BID, and causes its LED marked COMMUNICATION to flash.

The identity returned by the operating device is then checked in the blasting machine. If the identity is incorrect, the blasting machine retransmits its identity to the operating device. If the identity is correct, the transmission pointer value is set to 2, which causes the blasting machine to send a request for the identity of the operating device having the prefix SOI, and to flash the LED marked COMMUNICATION. In response to this request, the operating device transmits its identity with the prefix OWN. The blasting machine now stores the identity of the operating device in a memory, and returns it to the operating device with the prefix TST. The operating device receives its own identity from the blasting machine and checks that it has been correctly interpreted by the blasting machine. If it has not been correctly interpreted, the operating device retransmits its identity to the blasting machine, with the prefix OWN. This is repeated until the blasting machine returns the correct identity to the operating device. When the correct identity has been received by the operating device, it transmits a message to this effect to the blasting machine, with the prefix DOK.

When the blasting machine receives the message with the prefix DOK, the transmission pointer value is set to 3 and the blasting machine transmits a first encryption block with the prefix DAT. The block is received and stored in the operating device in the first available block space in the block memory. The encryption block is returned by the operating device to the blasting machine, with the prefix DAT, upon receipt of which the blasting machine checks that the operating device has interpreted the block correctly. If the correct block has been returned, the blasting machine transmits an acknowledgement with the prefix DOK. When the operating device receives the acknowledgment, it increments the block pointer one step and waits for the next encryption block. These steps are repeated until all encryption blocks have been correctly transmitted to the operating device. When the transmission of encryption blocks is terminated, an acknowledgment to this effect is transmitted from the blasting machine to the operating device with the prefix EOT. This terminates the association procedure, and the operating device and the blasting machine return to their state of rest.

In the preferred embodiment of the association, all the transmitted data is returned to the sender, thus allowing the sender to check that the receiver has interpreted the data correctly.

Accordingly, it is preferred for the association to comprise both the step of transmitting the unique identity of the blasting machine to the operating device and the unique identity of the operating device to the control unit and the step of transmitting an encryption table from the blasting machine to the operating device. The identities are intended to be used in the communication between the operating device and the blasting machine to further reduce the risk of erroneous data being interpreted by the receiving unit. It is preferred for the transmitting unit (the sender) to transmit the identity of the receiving unit with each transmission of data. The receiving unit thereby expects its own identity to be included in each piece of received data, and will only accept data containing its own identity. Furthermore, for the purpose of additional security selected parts of the data transmitted from the operating device to the blasting machine are encrypted in accordance with the encryption table.

When the operating device and the blasting machine have been introduced to each other (associated with each other), the operating device can be removed from the holder on the blasting machine and used to wirelessly transmit commands to the blasting machine. One example of controlling by means of the operating device is charging and firing of the detonator round connected to the blasting machine.

Figure 4:
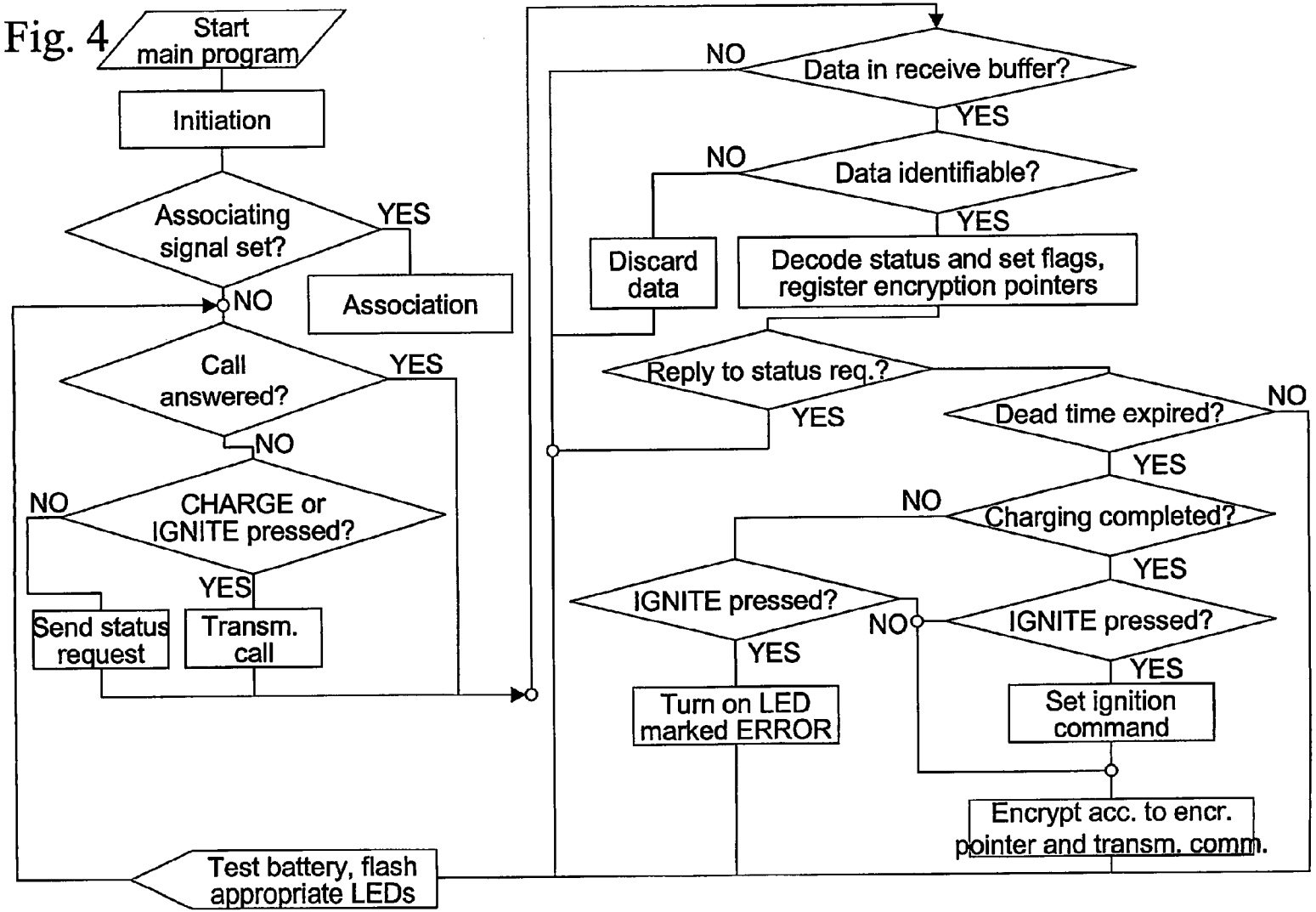
FIG. 4 is a block diagram describing the process in the operating device when charging and firing the round.

The signalling procedure for wirelessly charging (arming) and firing a round from the operating device will be described below with reference to the block diagram in FIG. 4.

The data transmitted between the operating device and the blasting machine consists of a number of bytes. The following symbols are used to describe the communication protocol:

T=a byte in the identity of the blasting machine
R=a control byte for the blasting machine
M=a byte in the identity of the operating device
S=a status byte (status of the blasting machine)
C=a command byte (command to the blasting machine)
K=a pointer in an encryption table, randomly selected for each transmission, no byte is indicated more than once
0=NUL, i.e. byte OOH
( )=Parentheses mean that the data is encrypted according to the encryption pointer of the previous message.

The communication protocol is based on a majority of two out of three for each byte. This means that each byte is transmitted three times, and that the receiver has to interpret at least two of these as identical for the data to be accepted.

Encryption/Decryption is done by performing an XOR operation bit by bit on plain text/encryption text with the byte of the encryption entry indicated by the encryption pointer. This means that, during encryption, a text byte is compared to a byte in the encryption entry, identical bytes giving a 1 and different bytes giving a 0. The encrypted text thus consist of 1's in the positions where the encryption entry corresponds to the plain text and of 0's in the other positions. For symmetry reasons, decrypting the encrypted data using the same logic will restore the original plain text. A byte that is first encrypted according to this system and then decrypted with the same encryption byte is guaranteed to be identical to the original byte.

In the preferred embodiment, the operating device continuously checks that the association is maintained and that the blasting machine is ready to start a firing sequence. This is done by the operating device transmitting a status enquiry to the blasting machine, which responds by transmitting its status to the operating device. If the association is maintained and the blasting machine is ready to start a firing sequence, the status OK is transmitted to the operating device, which responds by transmitting a new status enquiry. This procedure ensures that the operating device is always updated regarding status data relating to the blasting machine.

A firing sequence is initiated by pressing the CHARGE button provided on the operating device and maintaining it in this position. This causes the operating device to send an initial starting signal to the blasting machine. This signal consists of the signal T T T T T T 0 0, and in response the blasting machine transmits the signal M M M M M M S K. If status byte S contains information that the dead time has not yet run out, the operating device turns on the LED marked BLOCKED and the communication is discontinued. If not, the operating device transmits T T T T T T (R) (C). This signal is decrypted by the blasting machine. If the command C contains information that charging is to be initiated, the blasting machine initiates charging and transmits M M M M M M S K, the status byte S of which contains information that charging is in progress. In response, the operating device turns on the LED marked CHARGING, and transmits a status enquiry to the blasting machine, which again responds by transmitting the signal M M M M M M S K, the status byte of which contains information that charging is in progress. This exchange of status enquiries and status enquiry responses continues until the charging of the blasting machine has been completed. The blasting machine then transmits yet another M M M M M M S K signal, the status byte S of which contains information that charging has been completed. In response thereto, the operating device turns on the LED marked DONE. The detonator system is now ready to cause firing of the round. It should be noted that the CHARGE button must be maintained in its depressed position during the whole charging until firing of the round is to be performed.

Ignition, i.e. the actual firing of the detonators, is initiated by pressing also the button marked IGNITE provided on the operating device. When this is done, the operating device transmits the signal T T T T T T (R) (C), the command byte C of which contains a command for igniting (firing) the round.

During the whole firing sequence, three consecutive non-responses or erroneous responses from the operating device will cause the blasting machine to return to its state of rest, or normal state. This means that it discharges any ignition voltage internally and awaits a new charge signal. In this situation, the buttons of the operating device have to be released and the CHARGE button pressed and maintained in this position once more in order to restart the firing sequence.

The LED marked COMMUNICATION flashes during each transmission of data, thus informing the operator of the ongoing activity.

One example of the actual operation of the system according to the invention will be described below. The example provided below relates to charging and firing a round connected to the blasting machine. In the example, it is assumed that the operating device and the blasting machine have been associated with each other during a preceding introduction procedure as described above.

In the preferred embodiment, the blasting machine is equipped with three push buttons: TEST, ON and OFF. The status of the unit is displayed by means of five LEDs marked BATTERY, ERROR, COMMUNICATION, READY and ACTIVE.

The operating device is equipped with two push buttons marked CHARGE and IGNITE, and the system status (the status of the blasting machine) is displayed by means of five LEDs marked BATTERY, COMMUNICATION, BLOCKED, CHARGING and DONE. Preferably, the operating device is further equipped with a third push button marked SWITCH OFF. The SWITCH OFF button is intended to be used when the control unit associated with the operating device, i.e. the blasting machine, is to be switched off. It may be desirable, for example, to switch off the blasting machine before someone approaches the blast site or the blasting machine/round. The SWITCH OFF button is usually protected by a lid, a cover or the like for the purpose of preventing the blasting machine form being switched off inadvertently.

Initially, the operator pushes the TEST button on the blasting machine and maintains it in its depressed position. This will cause all the LEDs on the blasting machine to be turned on, and they will remain turned on for a few seconds. During this time, the blasting machine is adapted to carry out an internal test. If the unit is fully operational all LEDs will then be turned off, with the exception of the LED marked READY. It is possible that also BATTERY remains turned on, which then indicates that the battery of the blasting machine needs to be charged. If the LED marked ERROR is not turned off, this indicates that something is defective. It may be, for instance, that the round has been incorrectly connected to the blasting machine or that the blasting machine is defective and in need of repair. If the LED marked ERROR remains turned on, the defect has to be remedied before the system can be activated.

To activate the detonator system, the operator then pushes the button ON, which causes the LED marked READY to flash. The operator can now release the two buttons.

The fact that the LED marked READY flashes indicates that the blasting machine is in operation waiting for a dead time to expire. During this dead time, which may be for example 5 minutes, the blasting machine is blocked and cannot be armed, and it will respond to a call from the operating device with a message saying that it is blocked. When the dead time has expired, the LED marked ACTIVE begins to flash, which means that the blasting machine is active and, thus, responsive to control commands from the operating device. For security reasons, the blasting machine is only active during a limited period of time, for example 30 minutes, and then closes down automatically.

To initiate firing of the round, the operator first pushes the CHARGE button on the operating device. This causes the operating device to send a charge command to the blasting machine. If the dead time of the blasting machine has not expired, or if the LED marked ERROR provided thereon is turned on, the blasting machine responds by transmitting message indicating that it is blocked to the operating device, the LED marked BLOCKED being turned on. The CHARGE button then has to be released, and the expiration of the dead time awaited, or the defect, if any, has to be remedied. However, if the blasting machine is active, charging of the detonators in the round is initiated and charging data is transmitted to the operating device, the LED marked CHARGING on the operating device being turned on. If the LED marked CHARGING on the operating device is turned on, this means that the blasting machine has accepted the transmitted charge command and that charging is in progress.

When charging has been completed, the round thus being armed, the blasting machine transmits data indicating that it is done to the operating device, the LED marked DONE on the operating device being turned on. Turning on the LED marked DONE indicates that the blasting machine is charged, or armed, and thus that it is ready to fire the round. By pressing the IGNITE button, the operator then sends a fire command from the operating device to the blasting machine, which in response thereto causes firing of the round.

The invention has been described above by way of a preferred embodiment. It will be appreciated, however, that other implementations are possible without departing from the scope and spirit of the invention as defined by the appended claims.

The invention claimed is:

1. A method for wirelessly controlling a control unit selected from a plurality of control units in a detonator system by means of an operating device selected from a plurality of operating devices, the selected control unit being further connected to a round of detonators and controlling the function thereof, comprising the steps of associating the selected operating device and the selected control unit with each other, a dedicated communication protocol for wireless communication between the selected operating device and the selected control unit being established, which allows communication only between the selected operating device and the selected control unit including the sub-steps of registering the identity of the selected operating device in the control unit, and transmitting the identities together with control data during communication in accordance with the established communication protocol, and transmitting control data in accordance with said communication protocol from the operating device to the control unit, wherein the communication protocol requires encryption of predetermined parts of the data to be transmitted from the operating device to the control unit before transmission thereof, and wherein the step of associating the operating device and the control unit with each other comprises the sub-step of transmitting encryption data between the operating device and the control unit, and the step of transmitting control data comprises the sub-step of encrypting, by means of said encryption data, selected arts of the data to be transmitted from the operating device to the control unit, said encryption data comprises a encryption table containing a number of encryption entries.

2. A method according to claim 1, wherein the step of associating the operating device and the control unit with each other comprises the sub-step of defining a label unique to the association that is registered both in the control unit and in the operating device, the communication protocol for wireless communication requiring transmission of the label, and the transmitted label being verified against the defined label in the receiving unit.

3. A method according to claim 1, wherein the communication protocol requires transmission of a receiver identity and wherein the transmitted receiver identity is verified against the registered identity in the receiving unit.

4. A method according to claim 1, wherein the identity of each unit is an address unique to the unit.

5. A method according to claim 1, wherein the step of transmitting the control data in accordance with the communication protocol comprises the sub-step of transmitting an encryption pointer from the control unit to the operating device, the encryption pointer indicating the encryption entry in the encryption table to be used in the next data encrypting operation.

6. A method according to claim 5, wherein a particular encryption entry is indicated only once and then deleted.

7. A method according to claim 1, wherein the control data transmitted from the operating device to the control unit comprises a fire command instructing the control unit to fire the round.

8. A method according to claim 7, wherein the fire command is encrypted.

9. A method according to claim 1, wherein the control data transmitted from the operating device to the control unit comprises an arm command instructing the control unit to arm the round.

10. A method according to claim 9, wherein the arm command is encrypted.

11. A method according to claim 1, wherein the step of associating the operating device and the control unit with each other is carried out in connection with the charging of batteries in the operating device.

12. A method according to claim 1, wherein the step of associating the operating device and the control unit with each other is carried out in connection with the charging of batteries in the operating device which is done when the operating device is in contact with the control unit.

13. A method for wirelessly controlling a control unit selected from a plurality of control units in a detonator system by means of an operating device selected from a plurality of operating devices, the selected control unit being further connected to a round of detonators and controlling the function thereof, comprising the steps of associating the selected operating device and the selected control unit with each other, a dedicated communication protocol for wireless communication between the selected operating device and the selected control unit being established, which allows communication only between the selected operating device and the selected control unit including the sub-steps of registering the identity of the selected operating device in the control unit, and transmitting the identities together with control data during communication in accordance with the established communication protocol, and transmitting control data in accordance with said communication protocol from the operating device to the control unit, wherein transmission of control data from the operating device to the control unit comprises the steps of initiating the transmission from the operating device by sending an addressed initiation message to the control unit, confirming initiation from the control unit by sending an addressed confirmation message to the operating device, the confirmation message further comprising an encryption pointer indicating an encryption entry to be used when transmitting the control data, encrypting, in the operating device, selected parts of the data to be transmitted, the indicated encryption entry being used for the encrypting, and transmitting the encrypted data from the operating device to the control unit in an addressed message.

14. A detonator system comprising:

a plurality of control units, and a plurality of operating devices, the control units and operating devices being designed in such manner that a control unit and an operating device selected from the plurality of control units and operating devices are associable with each other by establishing a dedicated communication protocol, the communication protocol allowing secure wireless communication of control information from the selected operating device to the selected control unit associated therewith, said control unit being connected to and arranged to control the operation of a round of detonators based on control information communicated from the operating device to the control unit according to said protocol, wherein the dedicated communication protocol requires transmission of a receiver identity in the case of wireless communication between the selected operating device and the selected control unit, wherein at least one of the selected operating device and the selected control unit is adapted to encrypt predetermined parts of the data to be transmitted wirelessly in accordance with the communication protocol, and wherein the control unit is adapted to generate an encryption table and also to transmit the encryption table to the operating device in connection with the association of the control unit and the operating device with each other.

15. A detonator system according to claim 14, wherein the dedicated communication protocol requires transmission of a label unique to the association in the case of wireless communication between the selected operating device and the selected control unit.

16. A detonator system according to claim 14, wherein the receiving unit is adapted to check that the receiver identity corresponds to the actual identity of the receiver.

17. A detonator system according to claim 14, wherein the receiver identity is an address unique to the receiving unit.

18. A detonator system according to claim 14, wherein the encryption table comprises a number of encryption entries.

19. A detonator system according to claim 18, wherein the control unit is adapted to wirelessly transmit to the operating device a pointer indicating the encryption entry in the encryption table to be used in the next encrypting operation.

20. A detonator system according to claim 19, wherein the control unit is adapted not to transmit a pointer indicating a previously indicated encryption entry.

21. A detonator system according to claim 14, wherein the operating device is adapted to wirelessly transmit an arm command to the control unit, the arm command instructing the control unit to arm a round connected to the control unit.

22. A detonator system according to claim 21, wherein the operating device further is adapted to encrypt the arm command before it is wirelessly transmitted to the control unit.

23. A detonator system according to claim 14, wherein the operating device is adapted to wirelessly transmit a fire command to the control unit, the fire command instructing the control unit to fire a round connected to the control unit.

24. A detonator system according to claim 23, wherein the operating device further is adapted to encrypt the fire command before it is wirelessly transmitted to the control unit.

25. A detonator system according to claim 14, wherein the control unit is provided with a holder in which the operating device is to be placed when the operating device and the control unit are associated with each other.

26. A detonator system according to claim 14, wherein the control unit further is adapted to wirelessly transmit data regarding its current state to the operating device.

* * * * *